United States Patent [19]

Shibuya

[11] Patent Number: 5,020,431

[45] Date of Patent: Jun. 4, 1991

[54] GUIDE ROLLER APPARATUS FOR ROTARY PRESS

[75] Inventor: Yasuo Shibuya, Kodaira, Japan

[73] Assignee: Tokyo Kikai Seisakusho, Ltd., Tokyo, Japan

[21] Appl. No.: 305,669

[22] Filed: Feb. 3, 1989

[30] Foreign Application Priority Data

Feb. 18, 1988 [JP] Japan ..... 63-34002

[51] Int. Cl.[5] ..... B41F 13/54

[52] U.S. Cl. ..... 101/228; 101/219; 226/189; 226/195

[58] Field of Search ..... 101/228, 181, 219, 224, 101/225, 227; 400/618; 226/189, 195, 108

[56] References Cited

U.S. PATENT DOCUMENTS 4,688,485 8/1987 Tison ..... 101/228 X

*Primary Examiner*—Edgar S. Burr
*Assistant Examiner*—Moshe I. Cohen
*Attorney, Agent, or Firm*—Armstrong, Nikaido, Marmelstein, Kubovcik & Murray

[57] ABSTRACT

The guide roller apparatus in a rotary press using a paper roll includes: rotatable guide rollers; and a power transmission mechanism for connecting two or more guide rollers with each other in such a manner that at least one of the guide rollers is rotated at a circumferential speed different from those of the other guide rollers.

2 Claims, 2 Drawing Sheets

GUIDE ROLLER APPARATUS FOR ROTARY PRESS

BACKGROUND OF THE INVENTION

This invention relates to a guide roller apparatus in a rotary press that uses a paper roll and more particularly to a guide roller apparatus that can prevent wet ink, immediately after printing, from piling on the circumferential surfaces of the guide rollers or that can clean the wet ink from the guide roller surfaces.

The piling of ink on the guide roller's circumferential surfaces in the rotary press is a serious problem in the printing process. Various measures to solve this problem have been employed.

For example, as shown in the Japanese Utility Model Application Publication No. 22312/1961, the circumferential surfaces of the guide rollers are made rough and irregular so that they will not easily collect oily materials. Another example is the Japanese Utility Model Application Publication No. 26946/1964, in which the circumferential surfaces of guide rollers are provided with air blowing openings to form a layer of air between the guide rollers and the web of paper thereby reducing the contact area between the paper web and the guide rollers' circumferential surfaces or the chance of their contact to prevent ink from piling on the rollers. Still another example is the Japanese Patent Application Laid-Open No. 149449/1987, in which the guide rollers are connected with a drive means or a braking means to control the rotation of the guide rollers at circumferential speeds different from the speed of the running paper web to rub the guide roller surfaces with the paper web, thus preventing the ink from piling and cleaning the roller surfaces.

Of the above measures employed in the conventional rotary press to prevent ink from piling on the guide roller circumferential surfaces, the one that reduces the contact area between the paper web and the guide roller circumferential surfaces or reduces the contact chance, is not sufficiently effective as the printing speed and the amount of printing have increased in recent years. Thus, the rotary press using this preventive measure requires manual efforts in cleaning the guide roller surfaces of the piled ink. This poses two problems—low efficiency, i.e., a large number of man-hours are required, and hazardous environment to which maintenance workers are exposed as the guide rollers are usually installed at high locations.

In the rotary press using a measure where the guide rollers run at circumferential speeds different from the speed of the running web to rub the guide roller circumferential surfaces with the paper web and thereby prevent ink from piling on the roller surfaces to keep them clean, the problems presented by the abovementioned countermeasure are solved. However, this measure requires a drive means and a means to control the circumferential speeds of the guide rollers. Since the rotational force transmitted from the running web to the circumferential surface of the guide roller various depending on an enwrap angle at which the web is wound around the guide roller's circumferential surface, it is necessary to restrict the rotation of each guide roller with a properly controlled braking force. This in turn requires a brake for each guide roller and a braking force adjusting means for each brake, increasing the facility cost.

SUMMARY OF THE INVENTION

It is the primary object of the present invention to provide a guide roller apparatus for a rotary press which has a means by which the guide rollers are run at circumferential speeds different from the speed of the running web of paper to rub the guide rollers' circumferential surfaces with the web in order to prevent ink from piling on the guide rollers or to clean them without having to reduce the contact area between the guide roller circumferential surfaces and the web or the chances of their contact.

It is another object of the invention to provide a guide roller apparatus for a rotary press which does not require a drive means and a guide rollers' circumferential speed control means, nor requires a brake for each guide roller and a braking force adjusting means for each brake in running the guide rollers at circumferential speeds different from the speed of the running web to rub the guide roller circumferential surfaces with the web.

In the guide roller apparatus of a rotary press according to this invention, a series of guide rollers arranged to form a path for the running paper web are rotated by the web, which runs guided by and in contact with the circumferential surfaces of the guide rollers, i.e., by the frictional force between the guide rollers' circumferential surfaces and the running paper web.

The guide rollers installed in the path of the web have different web enwrap angles. Of the guide rollers that are interconnected by a power transmission mechanism, a guide roller with a greater web enwrap angle tends to rotate together with the interconnected guide roller at a circumferential speed determined by the frictional force between its surface and the web. However, the latter guide roller is restricted by a power transmission mechanism in such a way that it will rotate at a rotating speed different from that of the former guide roller.

Hence, there is a difference between the circumferential speed of the latter guide roller and the speed of the running web, so that the rotating speeds of both guide rollers are affected by the frictional force between the running web and the guide rollers' circumferential surfaces.

When, for example, the latter guide roller is made to rotate faster that the former, the speed of the web is slower than the circumferential speed of the latter guide roller, creating a frictional force between the running web and the latter guide roller, though the web enwrap angle on the latter guide roller is small. This frictional force acts, as a braking force, on the latter guide roller and therefore the former guide roller. Thus, the former guide roller is rotated at a circumferential speed lower than the speed of the running web, and the latter guide roller at a circumferential speed higher than the speed of the web. The rotational torques produced by the frictional forces between the two guide rollers' surfaces and the running web are balanced. The slight differences between the guide rollers' circumferential speeds and the speed of the running web results in the guide rollers' surfaces being rubbed with the running web, so that the guide roller surfaces are automatically prevented from being piled with ink or cleaned of piled ink.

BRIEF DESCRIPTION OF THE DRAWINGS

Other features and advantages of the present invention will be apparent from the following description taken in connection with the accompanying drawings, wherein.

DESCRIPTION OF THE PREFERRED EMBODIMENTS

Figure 1:
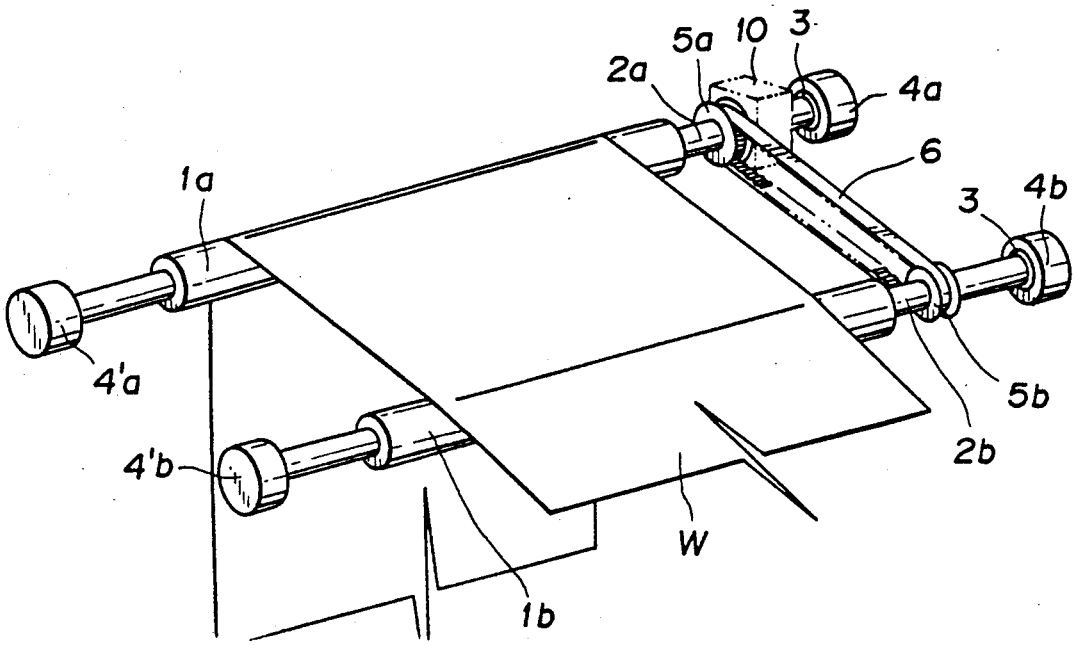
FIG. 1 is a perspective view of a guide roller apparatus of the rotary press as a first embodiment of this invention.
Figure 2:
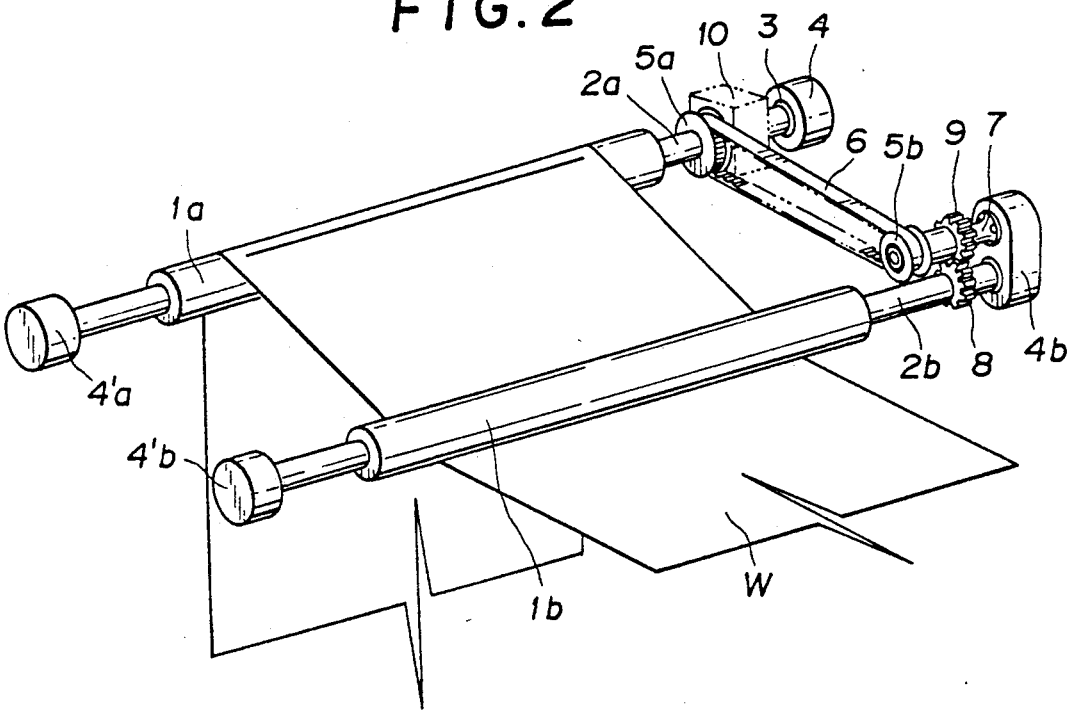
FIG. 2 is a perspective view of a guide roller apparatus of the rotary press as a second embodiment of the invention.

In a rotary press using a paper roll, an array of guide rollers mounted in the superstructure form a guide roller apparatus as shown in FIGS. 1 and 2.

FIG. 1 shows a first embodiment of the guide roller apparatus, in which a web of paper W is running on two guide rollers 1*a*, 1*b* with the same surface of the web contacting the rollers.

A shaft portion 2*a* of the guide roller 1*a* and a shaft portion 2*b* of the other guide roller 1*b* are rotatably supported on a frame (not shown) through bearing brackets 4*a*, 4*b* with built-in bearings 3, on one side, and on the other side through brackets 4'*a*, 4'*b* which also incorporate bearings (not shown).

Secured to the shaft portions 2*a*, 2*b* on the side of the bearing brackets 4*a*, 4*b* are tooth belt pulleys 5*a*, 5*b*, which are slightly different from each other in pitch circle diameter, i.e., the number of teeth. Both of the tooth belt pulleys 5*a*, 5*b* are connected through a tooth belt 6. Thus, the guide roller 1*a* and the guide roller 1*b* rotate in the same direction at speeds which are inversely proportional to the gear ratio between the tooth belt pulleys 5*a* and 5*b*.

The guide rollers 1*a*, 1*b* are installed in the path of the running web in such a way that they have different web enwrap angles over which the paper web W contact the rollers. The enwrap angle of the guide roller 1*a* is larger than that of the guide roller 1*b*.

FIG. 2 shows a second embodiment of the guide roller apparatus in which two guide rollers 1*a*, 1*b* are placed in contact with opposite surfaces of the running web of paper W.

This guide roller apparatus is identical with the first embodiment, except for the rotation transmission mechanism between the two guide rollers 1*a* and 1*b*.

The construction of the apparatus on the side of the guide roller 1*a* is similar to that of the first embodiment, but on the side of the guide roller 1*b* a short shaft 7 running parallel to the shaft portion 2*b* is supported on the bearing bracket 4*b*. The shaft portion 2*b* has a gear 8 secured thereto, and the short shaft 7 has rotatably mounted thereon a gear 9 and a tooth belt pulley 5*b* on the same axis, both of which are formed in one piece.

The gear 8 and the gear 9 have the same number of teeth and are in meshing engagement, while the tooth belt pulleys 5*a*, 5*b* have slightly different pitch circle diameters, i.e., the different numbers of teeth. As a variation, the gears 8 and 9 may have different numbers of teeth, with the pitch circle diameters or the numbers of teeth of the tooth belt pulleys 5*a*, 5*b* set equal. The tooth belt pulleys 5*a*, 5*b* are connected through a tooth belt 6. Thus, the guide rollers 1*a* and 1*b* rotate in opposite directions at speeds which are inversely proportional to the gear ratio between the tooth belt pulleys 5*a* and 5*b* (in the variation, to the gear ratio between the gears 9 and 8).

In the above two embodiments, both or one of the shaft portions 2*a*, 2*b* are provided with a clutch 10 to disconnect from the guide rollers 1*a*, 1*b* both or one of the tooth belt pulleys 5*a*, 5*b* in the first embodiment or both or one of the tooth belt pulley 5*a* and the gear 8 in the second embodiment so that they are freely rotatable.

While in the above embodiments two guide rollers 1*a*, 1*b* are interconnected, it is also possible to connect three or more guide rollers as required.

When there are three or more guide rollers connected with each other, the clutch 10 may be provided in such a manner that one of the guide rollers whose rotating speed is different from those of the remaining guide rollers is disconnected from the power transmission mechanism.

Although the guide roller apparatus with the above construction may be applied to any guide rollers in the rotary press, it is more effective to apply the apparatus to those guide rollers immediately behind the printing section where ink piling is most likely to occur.

In this invention what matters is not the rotating speed of the guide rollers but its peripheral speed, which is proportional to the rotating speed of the guide roller. In the above embodiments, all guide rollers have almost equal diameters.

The action of the above guide roller apparatus will now be explained.

The guide rollers 1*a*, 1*b* of the guide roller apparatus installed in the path of the running web of paper W at the superstructure section are rotated by the web, which travels guided by and in contact with the guide rollers, 1*a*, 1*b*, i.e., the rollers are rotated by the frictional force between the circumferential surfaces of the guide rollers 1*a*, 1*b* and the web W.

In the path of the running web W, the guide roller 1*a* with a greater web enwrap angle tends to rotate together with the interconnected guide roller 1*b* at a circumferential speed determined by the frictional force between its circumferential surface and the running web W. However, the guide roller 1*b* is restricted by a tooth belt drive mechanism so that it will rotate at a rotating speed different from that of the guide roller 1*a*. Alternatively the tooth belt drive mechanism and a gear drive mechanism restrict the rotation of the guide roller 1*b* so that the speed and direction of rotation of the guide roller 1*b* are different from those of the guide roller 1*a*.

Hence, there arises a difference between the speed of the running web W and the circumferential speed of the guide roller 1*b*, so that the rotating speeds of the guide rollers 1*a*, 1*b* are affected by the frictional force between the running web W and the circumferential surface of the guide roller 1*b*.

If, for example, the tooth belt pulley 5*a* has a greater number of teeth than does the tooth belt pulley 5*b* (or in the case of the variation of the second embodiment, the number of teeth of the gear 9 is greater than that of the gear 8), the guide roller 1*b* rotates at a higher speed than does the guide roller 1*a*. Since the speed of the paper web W is smaller than the circumferential speed of the guide roller 1*b*, there occurs a frictional force between the running web of paper W and the circumferential surface of the guide roller 1*b*, though the web enwrap angle of the guide roller 1*b* is small. This frictional force acts as a braking force on the guide roller 1*b* and therefore on the guide roller 1*a*. Thus, the guide roller 1*a* is rotated at a circumferential speed slower than the running web W and the guide roller 1*b* is rotated at a circumferential speed faster than the web W, with the rotating torques—which are caused by the frictional forces between the circumferential surfaces of the guide rollers 1*a*, 1*b* and the running web W and act on these guide rollers—balanced.

Therefore, if the guide rollers 1*a* and 1*b* are connected and operated in this way in the printing process, the circumferential surfaces of these guide rollers 1*a*, 1*b* are continuously rubbed by the running web of paper W, preventing the piling of ink on the rollers.

When during the printing process it is desired to avoid friction on the printed surface of the web, the clutch 10 is operated to disconnect the guide rollers 1*a* and 1*b* from each other, allowing individual free rotations. Then after printing is over, the clutch 10 is actuated to bring the guide rollers 1*a* and 1*b* into engagement and a blank web is fed, thus cleaning the ink-piled circumferential surfaces of the guide rollers without requiring manual efforts.

In cleaning the roller surfaces after printing, it is possible to supply cleaning agent directly onto the circumferential surfaces of the guide rollers or indirectly through the web of paper.

While, in the above example, the tooth belt pulley 5*a* has a greater number of teeth than does the tooth belt pulley 5*b* (or in the case of the variation of the second embodiment, the gear 9 has a greater number of teeth than the gear 8) so that the guide roller 1*b* rotates faster than the guide roller 1*a*, it is also possible to provide the tooth belt pulley 5*b* with a greater number of teeth than the tooth belt pulley 5*a* (or in the variation of the second embodiment, the gear 9 may be provided with a greater number of teeth than the gear 8) so that the guide roller 1*b* rotates slower than the guide roller 1*a*. It is easily understood that the latter will also give a similar result in preventing the ink piling or cleaning the roller surfaces.

In preventing the ink piling on the guide rollers or cleaning the guide roller surfaces, the guide roller apparatus of this invention in the rotary press employs a method in which the circumferential speeds of the guide rollers are set different from that of the speed of the running web of paper to rub the circumferential surfaces of the guide rollers with the paper web. This eliminates the need for reducing the contact area between the paper web and the guide roller's circumferential surfaces or reducing the chances of their contact. This in turn increases the ability of the rotary press to process an increased printing volume at higher printing speeds. Furthermore, with this invention, the guide roller apparatus does not require a drive means and a means to control the circumferential speeds of the guide rollers to be different from the running speed of the web so as to rub the guide rollers' surfaces with the paper web. Nor does it require a brake for each guide roller and a braking force adjusting means for each brake. All that is required for cleaning the roller surfaces is a simple power transmission mechanism, which renders maintenance easy and running cost low.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A rotary printing press including a paper roller and having a plurality of guide rollers for guiding a paper web said guide rollers being rotated solely in response to movement of the paper web, a power transmission for connecting a first one of said guide rollers with at least a second one of said guide rollers, said power transmission including a power transfer member, means for drivingly connecting said first one of said guide rollers to said power transfer member, and means for drivingly connecting at least said second guide roller to said power transfer member to rotate said second one of said guide rollers at a peripheral speed of rotation different from the peripheral speed of rotation of said first guide roller, said power transfer member being driven solely by one of said guide rollers, the power transfer member being constructed to drive the means drivingly connecting the other guide roller to rotate the first and second ones of the guide rollers at respective peripheral speeds different from the surface speed of said paper web traversing said first and second ones of the guide rollers.

2. A rotary press as defined by claim 1 and including a clutch means for selectively engaging and disengaging one of said guide rollers from said power transmission member.

* * * * *